US007862194B2

(12) United States Patent
Seade

(10) Patent No.: US 7,862,194 B2
(45) Date of Patent: Jan. 4, 2011

(54) BASEBALL-STYLE CAP WITH AMPLIFIED STEREO SPEAKERS

(76) Inventor: John G. Seade, 12025 South St., Artesia, CA (US) 90701

( * ) Notice: Subject to any disclaimer, the term of this patent is extended or adjusted under 35 U.S.C. 154(b) by 318 days.

(21) Appl. No.: 12/194,792

(22) Filed: Aug. 20, 2008

(65) Prior Publication Data

US 2008/0304682 A1 Dec. 11, 2008

Related U.S. Application Data

(63) Continuation of application No. 11/337,993, filed on Jan. 25, 2006, now abandoned.

(51) Int. Cl.
*F21V 21/084* (2006.01)

(52) U.S. Cl. ..... 362/106; 362/105; 381/301; 2/209.13; 2/195.1

(58) Field of Classification Search ..... 362/106, 362/105, 253, 103, 107; 381/301, 385; 2/181, 2/209.13, 195.1, 209.3, 906
See application file for complete search history.

(56) References Cited

U.S. PATENT DOCUMENTS 4,130,803 A * 12/1978 Thompson ..... 455/344
4,525,878 A * 7/1985 Lowe, Jr. ..... 2/209.13
4,776,044 A * 10/1988 Makins ..... 2/209.13
5,410,746 A * 4/1995 Gelber ..... 455/344
5,510,961 A * 4/1996 Peng ..... 362/106
5,522,092 A * 6/1996 Streb et al. ..... 2/209.13
5,724,678 A * 3/1998 McCallum et al. ..... 2/209.13
5,845,987 A * 12/1998 Painter ..... 362/206
7,044,615 B2 * 5/2006 Gesten ..... 362/106
7,052,154 B2 * 5/2006 Vanderschuit ..... 362/105

* cited by examiner

*Primary Examiner*—Bao Q Truong
(74) *Attorney, Agent, or Firm*—Julio M. Loza; Loza & Loza, LLP

(57) ABSTRACT

An embodiment of a baseball style cap and stereo combination having a crown, a brim/bill, a sweatband, and two amplified stereo speakers concealed within the brim/bill is disclosed. The baseball-style cap combination further includes a battery holder/forehead cushion housing a battery holder concealed within an inner surface of the baseball-style cap combination by a flap. Also included are wires connecting the battery holder to an amplifier concealed within the sweatband and wires connecting the amplifier to the speakers. A stereophonic music generator sends a music signal which is provided to the amplifier by any suitable means of communication, like an audio cord or wireless by means of infrared or Bluetooth wireless technology.

20 Claims, 5 Drawing Sheets

FIG. 9
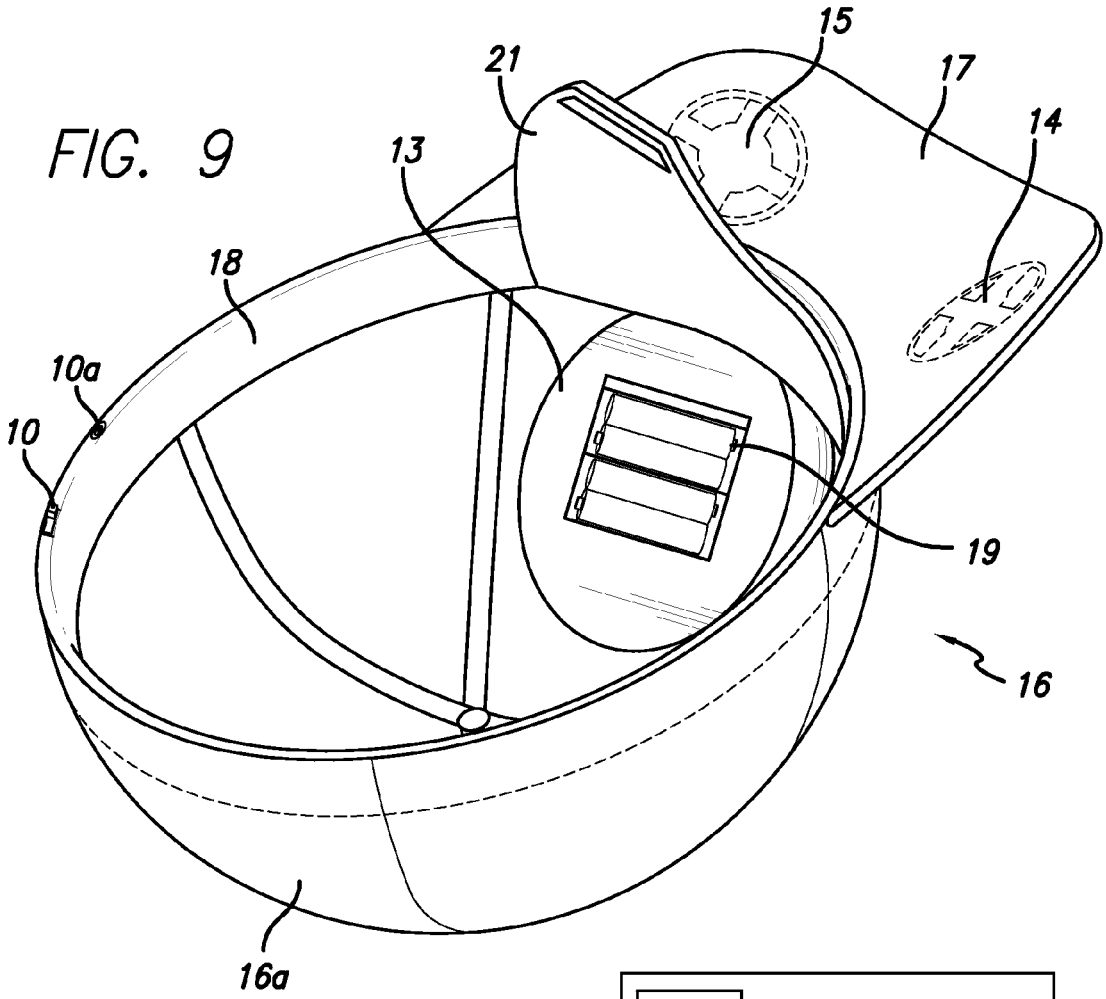
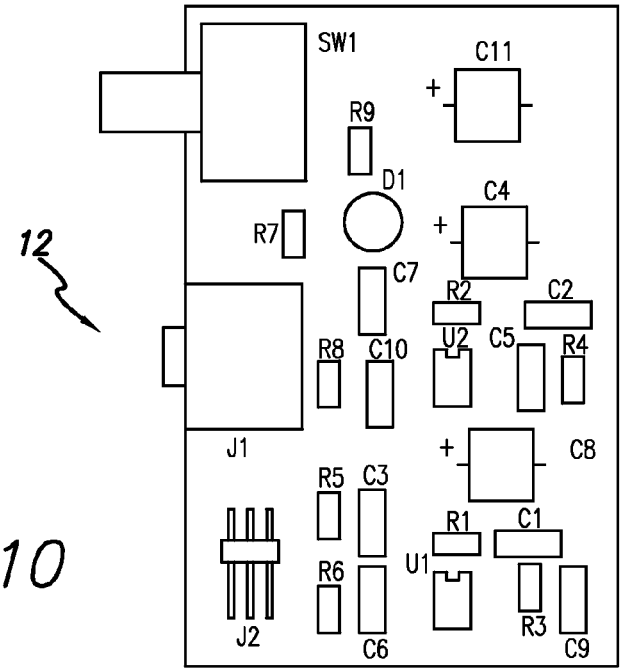
FIG. 10

BASEBALL-STYLE CAP WITH AMPLIFIED STEREO SPEAKERS

CLAIM OF PRIORITY UNDER 35 U.S.C. §120

The present Application is a continuation-in-part application of, and claims priority to, U.S. application Ser. No. 11/337,993 entitled "Baseball Style Cap with Amplified Stereo Speakers" filed Jan. 25, 2006, and hereby expressly incorporated by reference herein.

FIELD OF INVENTION

The present invention relates to combined headgear and electronic means to provide music. More specifically, the invention relates to a combined baseball type cap and music signal provided to the speakers integrated as part of the cap.

BACKGROUND OF INVENTION

U.S. Design Pat. No. 321,581 to Li discloses an ornamental combined cap and radio.

U.S. Pat. No. 5,410,746 to Gelber discloses headgear, such as a cap having a crown, a brim and an internal sweatband or flap, combined with an electronic receiving device, such as a radio, which is connected to the inner surface of the flap by a first double sided adhesive strip.

U.S. Pat. No. 5,510,961 to Peng discloses a cap structure with sound recording and generating means and warning lights includes digitalized sound recording and releasing means and light emitting diodes on a visor.

U.S. Pat No. 7,031,068 to Himmele disclose a hands-free binocular visor headgear for viewing sporting and other events where it is desirable to use binoculars but also have the free use of the hands.

When using mobile audio devices, it is helpful to deliver the sound as close as possible to the user's ears for better audio perception. However, using earbuds or headphones to deliver the sound also tends to block the listener from perceiving other sounds, such as emergency alarms, phone rings, or another person's words. Consequently, such conventional forms of audio delivery may place the user (and others around him/her) in danger if a warning or alarm is not heard due to the use of earbuds or earphones.

SUMMARY OF INVENTION

One novel embodiment provides a baseball-style cap having amplified stereo speakers. The baseball cap includes a crown adapted to fit a head of a user, a horizontally extending brim/bill attached to the crown, and a sweatband secured to an inner surface of the crown by at least one edge. Additionally, a contoured pliable battery holder having an opening therethrough may be positioned within the inner surface of the crown above the area of attachment of the horizontally extending brim/bill. The contoured pliable battery holder may comprise a flat surface and a convex surface, the flat surface facing inward and the convex surface facing outward. The flat surface may be adapted to substantially rest adjacent to a forehead of a user. In one example, the contoured pliable battery holder is approximately hemispherical-shaped. A flat surface of the contoured pliable battery holder may be adapted to substantially rest adjacent to a forehead of a user. The contoured rigid battery holder may be contoured to the shape of a forehead of the user.

A contoured rigid battery holder may be positioned within the opening of the contoured pliable battery holder. A flap having a first end and a second end may be included within the crown, where the first end is secured to the inner surface of the crown at the area of attachment of the horizontally extending brim/bill, and the second end is removably secured to the inner surface of the crown at an area above the contoured pliable battery holder by attaching means. A stand-alone amplifier may be positioned within the sweatband configured to amplify audio signals originating from an adjacent external signal source. At least two stand-alone speakers may be integrated within the brim/bill with their direction of sound propagation pointed downward from the brim/bill. The speakers may have a thickness equal to or less than the thickness of the brim/bill so that the speakers are concealed within the thickness of the brim/bill.

The baseball style cap may be adapted to receive a signal from an external music signal generator. For instance, the speakers may be connected by wire means to the amplifier. The battery holder is connected to the amplifier by wire means. The stand-alone amplifier may include a receiver to wirelessly receive the audio signals from the adjacent external signal source. Additionally, the amplifier may include an ON/OFF switch located on the side of the amplifier, the ON/OFF switch protruding through an edge of the sweatband. The amplifier may also include an LED light protruding through the edge of the sweatband, the LED light adapted to illuminate a blue light when the ON/OFF switch is turned ON. The amplifier may also include a female stereo audio jack connector, the female stereo audio jack connector configured to connect to a male connector of an external music signal generator. The external signal generator may include stereo audio cable means, the stereo audio cable means having a male connector to fit in the female stereo audio jack connector on the amplifier. A stereophonic signal is provided to the amplified stereo speakers to provide stereophonic music. The external music signal generator may be one of a compact disc player, MP3 player, AM/FM radio, a device with a 3.5 mm jack or a device that can provide stereophonic music signal.

Another embodiment may provide a baseball style cap having integrated stereo speakers. The cap may include a crown adapted to fit a head of a user, a horizontally extending brim/bill attached to the crown, a sweatband secured to an inner surface of the crown by at least one edge, a contoured pliable battery holder having an opening therethrough, the contoured pliable battery holder positioned within the inner surface of the crown above the area of attachment of the horizontally extending brim/bill. Additionally, a contoured rigid battery holder may be positioned within the opening of the contoured pliable battery holder. A flap having a first end and a second end may also be included within the crown, where the first end is secured to the inner surface of the crown at the area of attachment of the horizontally extending brim/bill, and the second end is removably secured to the inner surface of the crown at an area above the contoured pliable battery holder by attaching means. At least two stand-alone speakers may be integrated within the brim/bill with their direction of sound propagation pointed downward from the brim/bill. The speakers may have a thickness equal to or less than the thickness of the brim/bill so that the speakers are concealed within the thickness of the brim/bill wherein the baseball style cap is adapted to receive a signal from an external music signal generator. The cap may further include means to provide external audio signals to the speakers and means for amplifying audio signals originating from an adjacent external signal source prior to reaching the speakers. The contoured pliable battery holder may comprise a flat surface and a convex surface, the flat surface facing inward and the convex surface facing outward. The flat surface may be adapted to substantially rest adjacent to a forehead of a user. The contoured rigid battery holder may be contoured to the shape of a forehead of the user.

BRIEF DESCRIPTION OF DRAWINGS

FIG. 9 is a bottom view of the baseball-style cap and stereo combination of FIG. 1 with a flap extended.

FIG. 10 illustrates a circuit for use with the baseball-style cap and stereo combination of FIG. 1 according to an embodiment of the invention.

DETAILED DESCRIPTION

Figure 1:
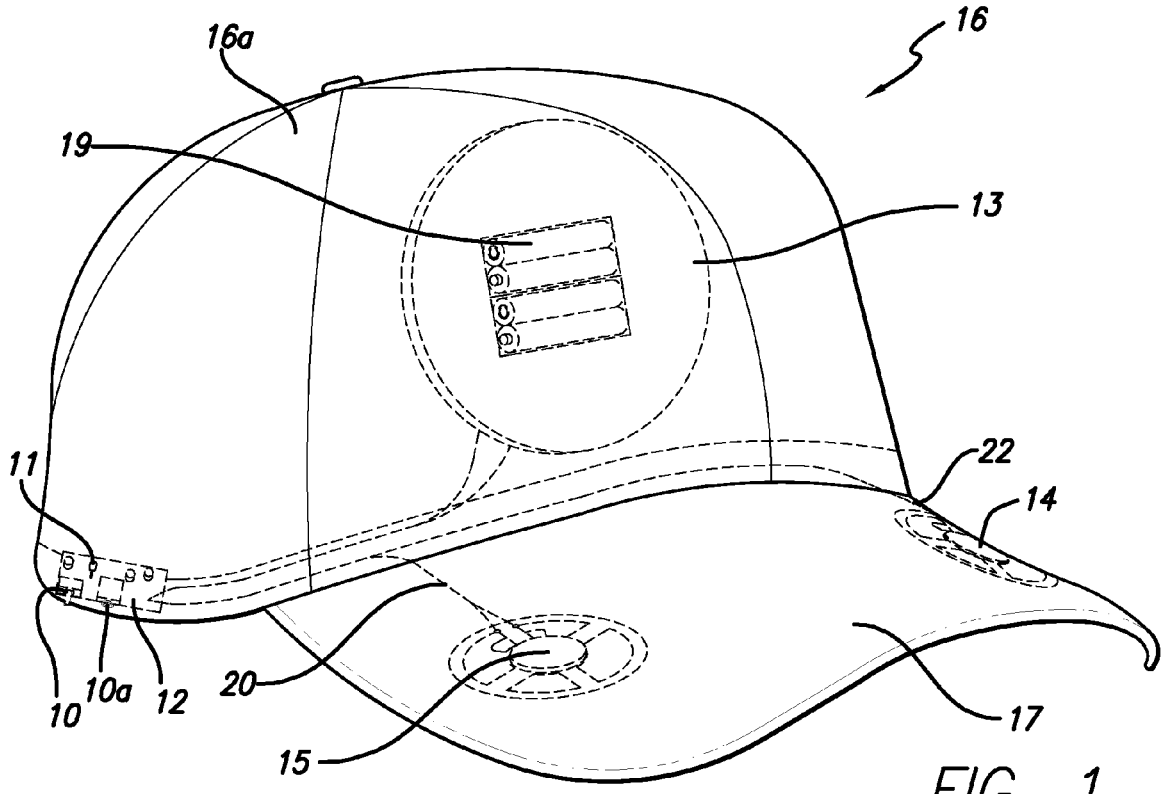
FIG. 1 is a perspective view of a baseball-style cap and stereo combination according to an embodiment of the invention.

FIG. 1 is a perspective view of a baseball-style cap and stereo combination according to an embodiment of the invention. The baseball-style cap combination 16 includes a crown 16*a*, an amplifier 12, a battery holder 13 with the batteries 19 in phantom, and stereo low profile micro-miniature speakers 14 and 15 within brim/bill 17. The cap may be of any conventional design and manufacture and includes a cap crown 16*a*, a brim/bill 17 and a peripheral sweatband 18. In one embodiment, only one edge of the sweatband 18 is sewn to the crown enabling the sweatband 18 to be pulled away from the crown 16*a* to enable access to the inner surface therein. This enables the wires from the battery holder 13 to allow threading in the sweatband 18 to the amplifier 12. This also allows wires from the amplifier 12 to the speakers 14 and 15. The ON/OFF switch 10 of the amplifier 12 is also shown in this view as the LED light 11 that when illuminated indicates that the amplifier is turned ON.

Figure 2:
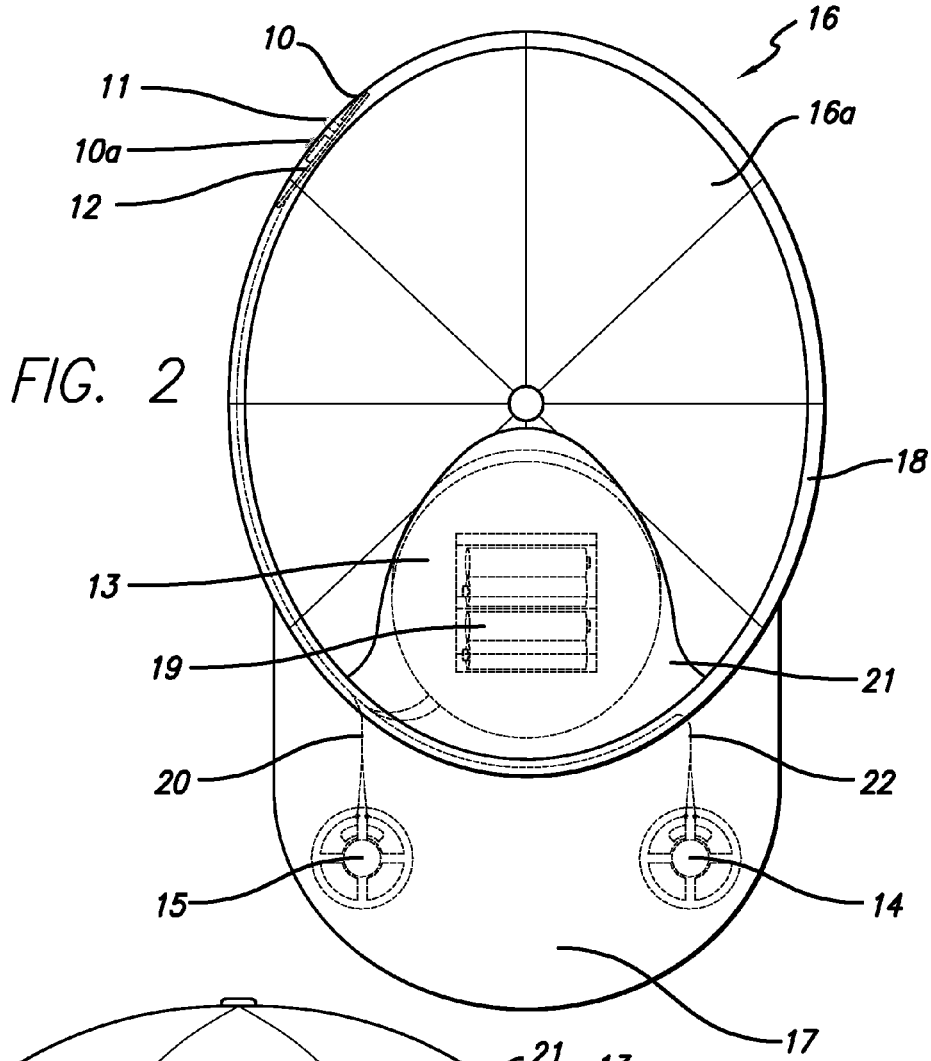
FIG. 2 is a bottom view of the baseball-style cap and stereo combination of FIG. 1.

FIG. 2 is a bottom view of the baseball-style cap and stereo combination of FIG. 1. In one embodiment, speakers 14 and 15 are enclosed by the cloth that covers the brim/bill 17 during assembly. In some embodiments, speakers 14 and 15 are "low profile micro miniature speakers" with rare earth magnets. Also shown are the battery holder 13, the amplifier 12, the sweatband or flap 18, the cap crown 16*a*, and the brim/bill 17. The speakers 14 and 15 may be sufficiently thin to fit completely within the thickness of the brim/bill 17. For example, the brim/bill 17 may be between ⅛ and 3⁄16 of an inch thick. Due to their thinness, the speakers 14 and 15 may be completely concealed within the brim/bill 17 and may be covered by an exterior cloth of the brim/bill 17.

Figure 3:
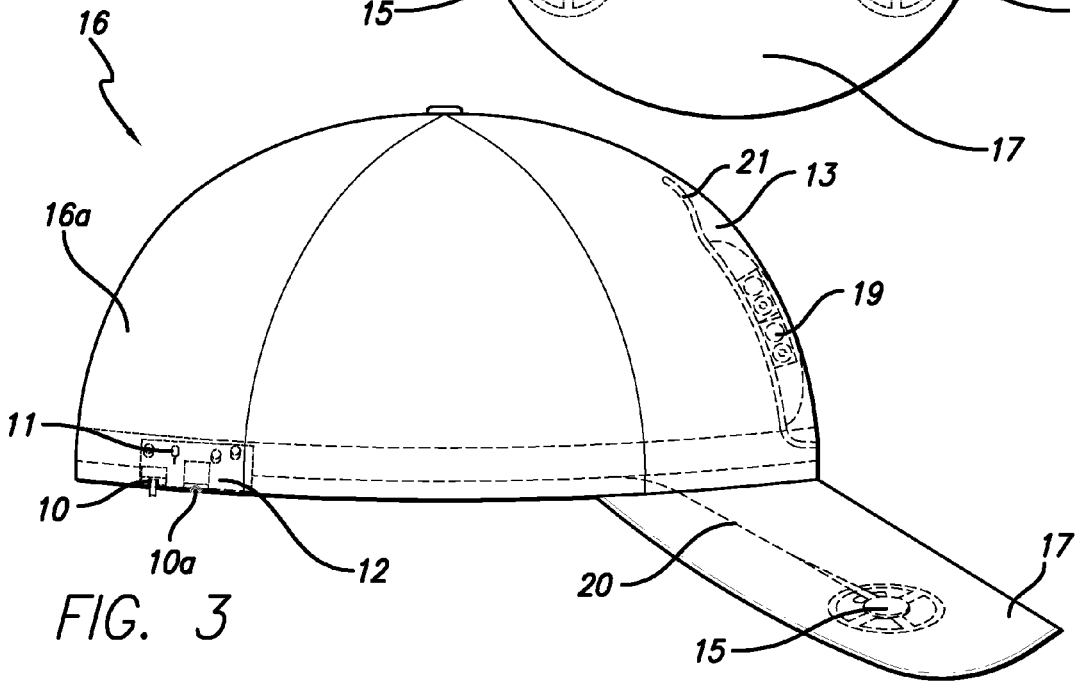
FIG. 3 is a left-side view of the baseball-style cap and stereo combination of FIG. 1.

FIG. 3 is a left-side view of the baseball-style cap and stereo combination of FIG. 1. As shown, FIG. 3 illustrates baseball-style cap combination 16 including stereo speaker 15, the amplifier 12, the ON/OFF switch 10, audio stereo jack 10*a*, and the LED light 11 that, when illuminated, indicates when the amplifier 12 is turned ON. FIG. 3 also illustrates the crown 16*a*, the brim/bill 17, the connecting wire 20, and speaker 15.

Figure 4:
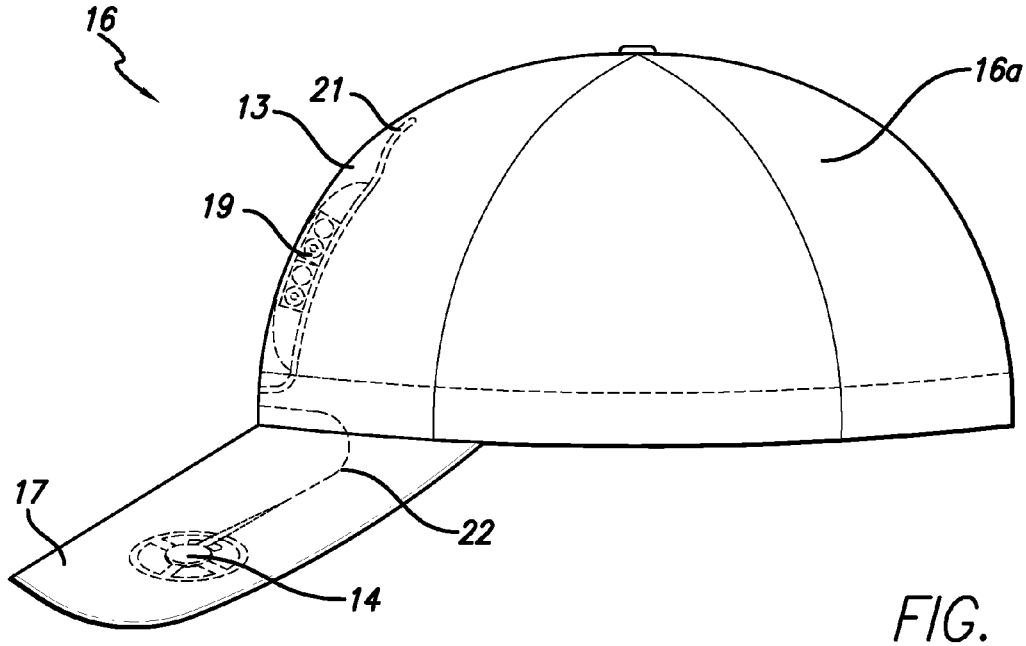
FIG. 4 is a right-side view of the baseball-style cap and stereo combination of FIG. 1.

FIG. 4 is a right-side view of the baseball-style cap and stereo combination of FIG. 1. As shown, FIG. 4 illustrates baseball-style cap combination 16 including stereo speaker 14, the battery holder 13 with the batteries 19 in phantom. In this view there is also seen brim/bill 17 and the top of the stereo speaker 14. The wires 22 connecting speaker 14 is also seen in this view.

Figure 5A:
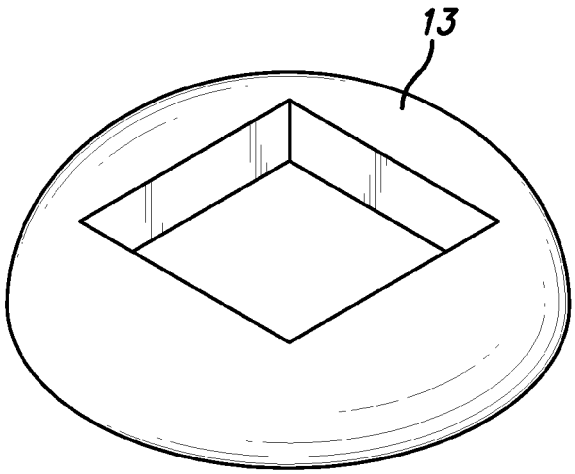
FIGS. 5A-5B are top and bottom views of a contoured pliable battery holder for use with the baseball-style cap and stereo combination of FIG. 1.
Figure 5B:
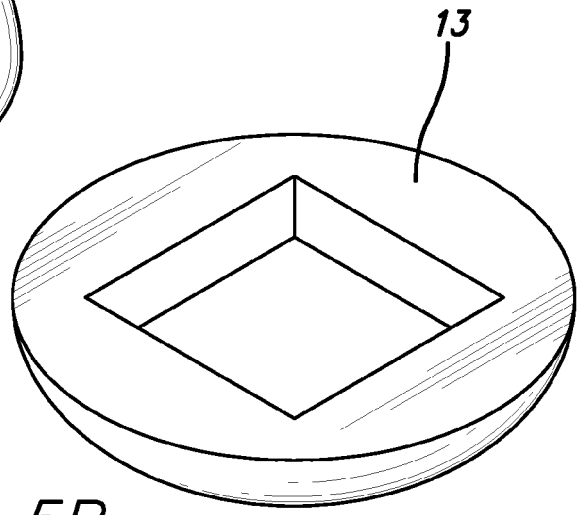

FIGS. 5A-5B are top and bottom views of a contoured pliable battery holder for use with the baseball-style cap and stereo combination of FIG. 1 according to an embodiment of the invention. The contoured pliable battery holder 13 may generally comprise a contoured surface and a flat surface. That is, the contoured pliable battery holder 13 may be approximately hemispherical-shaped. In one embodiment, the contoured surface may be approximately convex and include an opening adapted to hold a battery holder 19 (explained in more detail below). Generally, the flat surface faces the inner part of the baseball-style cap combination 16 (i.e., inward) while the contoured surface faces the outer part of the baseball-style cap combination 16 (i.e., outward). In one embodiment, the contoured pliable battery holder 13 may be positioned in a front portion of the baseball-style cap combination 16 approximately above the brim/bill 17; however, the contoured pliable battery holder 13 may alternatively be positioned at any location about the crown 16*a* of the baseball-style cap combination 16. The contoured pliable battery holder 13 may be made of ethylene-vinyl acetate (EVA) foam or an equivalent material.

Advantageously, the shape and configuration of the contoured pliable battery holder 13 substantially aligns with the contour of the baseball-style cap combination 16 resulting in a low- to no-profile of the contoured pliable battery holder 13. In this manner, an on-looker will likely not be able to observe the contoured pliable battery holder 13 within the baseball-style cap combination 16. Also, the foam acts a cushion to the forehead of a user and it is anticipated that the user will likely not feel the battery holder/forehead cushion 13 when wearing the baseball-style cap combination 16.

Figure 6:
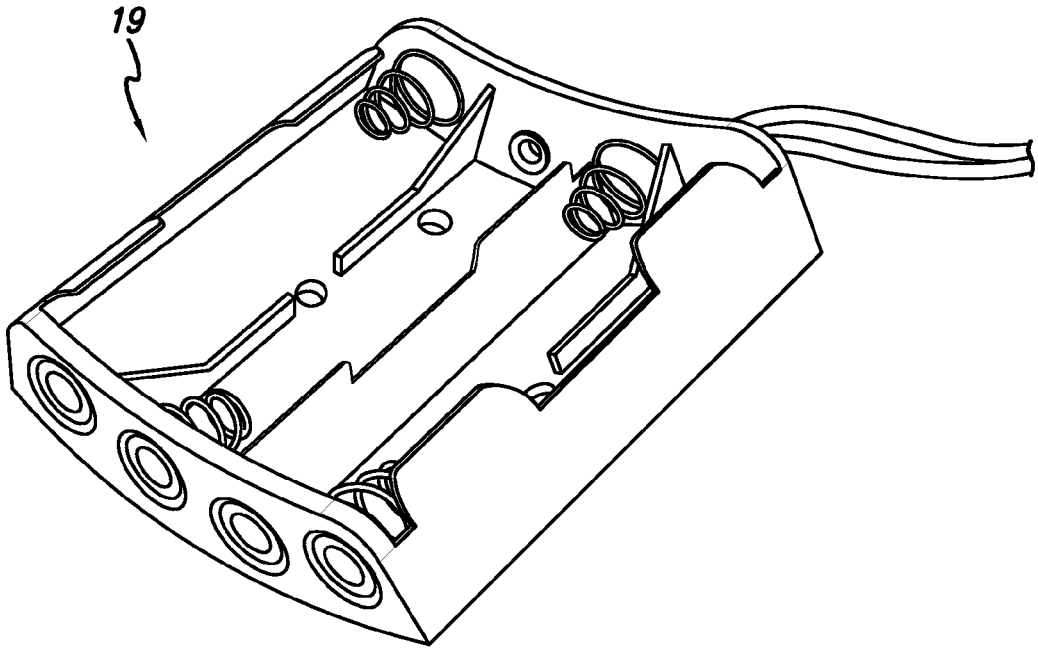
FIG. 6 is a perspective view of a contoured rigid battery holder for use with the baseball-style cap and stereo combination of FIG. 1 according to an embodiment of the invention.

FIG. 6 is a perspective view of a contoured rigid battery holder for use with the baseball-style cap and stereo combination of FIG. 1 according to an embodiment of the invention. In one embodiment, the contoured rigid battery holder 19 includes a convex surface and a concave surface. That is, the contoured rigid battery holder 19 is substantially contoured to simultaneously fit the curvature of a forehead of the user and the curvature of, for example, the baseball-style cap combination 16. The contoured rigid battery holder 19 may be made of injected plastic and may hold a plurality of batteries. In one embodiment, the contoured rigid battery holder 19 holds one or more batteries (e.g., four AAA-size batteries). In some embodiments, the contoured rigid battery holder 19 is configured to be approximately the same size as the opening in the contoured pliable battery holder 13.

Figure 7:
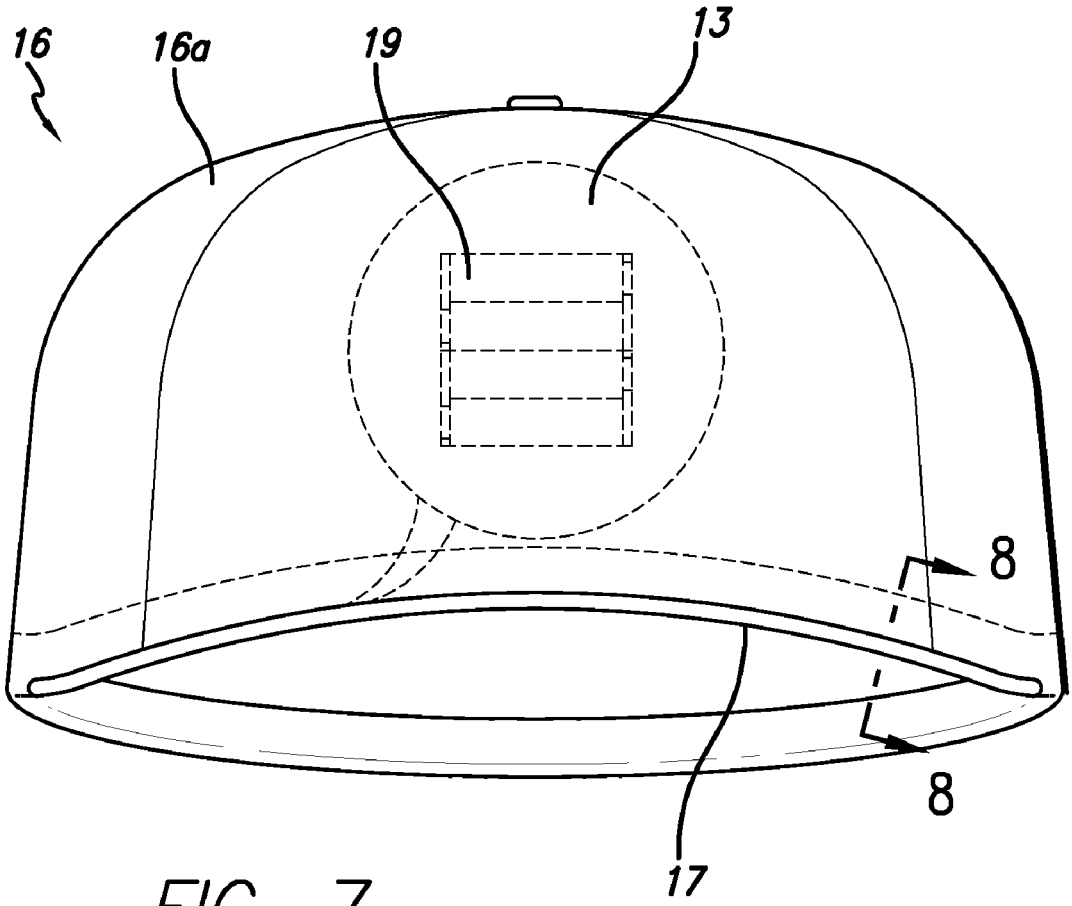
FIG. 7 is a front view of the baseball-style cap and stereo combination of FIG. 1.

FIG. 7 is a front view of the baseball-style cap and stereo combination of FIG. 1. As shown, FIG. 7 illustrates the baseball-style cap combination 16 including the cap crown 16*a* and the brim/bill 17. Also shown are the contoured pliable battery holder 13 and the battery holder/forehead cushion 19 in phantom. Advantageously, the speakers 14 and 15 cannot be viewed by an on-looker because they are low profile micro miniature speakers and substantially or completely incorporated within the brim/bill 17. Additionally, another benefit is that the speakers 14 and 15 will not block the view of the user when wearing the baseball-style cap combination 16 due to their low- to no-profile configuration (see FIG. 8 and accompanying text).

Figure 8:
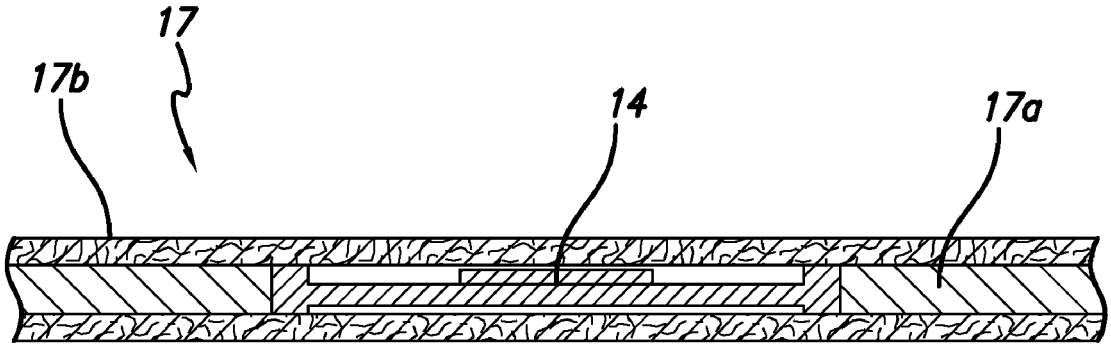
FIG. 8 is a cross-section of the baseball-style cap combination of FIG. 7 taken along lines 8-8.

FIG. 8 is a cross-section of the baseball-style cap combination of FIG. 7 taken along lines 8-8. As shown, FIG. 8 illustrates the brim/bill 17 having an inner portion 17*a* and an outer portion 17*b*. In some embodiments, inner portion 17*a* comprises injected plastic or equivalent and outer portion 17*b* comprises a covering such as porous audio cloth or equivalent. In one method of manufacturing, plastic is injected into a molding to form the brim/bill 17 leaving an opening for a speaker to be positioned therein. FIG. 8 illustrates the speaker 14 within inner portion 17*a* of the brim/bill 17. As shown, the speaker 14 is substantially or completely confined within inner portion 17*a*. Also, because the speakers 14 and 15 are positioned within the brim/bill 17, the projection of sound emanating therefrom is generally towards the front of the user's face rather than adjacent to the user's ears. In this respect, the user's ears are protected from sounds with too high of a frequency or decibel which may cause damage to the user's ears.

One advantage of positioning the speakers 14 and 15 in the brim/brill 17 is that the user's ears are not blocked or obstructed by earbuds or earphones. Therefore, the user can listen to desired audio via the speakers 14 and 15 while still being able to hear alarms, warnings, and/or another person's voice. For example, while a user is bicycling he/she may listen to music over the speakers 14 and 15 while still being able to listen to listen to ambulance sirens and car warning honks.

FIG. 9 is a bottom view of the baseball-style cap and stereo combination of FIG. 1 with a flap extended. As shown, FIG. 9 illustrates the baseball-style cap combination 16 including the crown 16*a*, the brim/bill 17, the sweatband 18, the ON/OFF switch 10, an audio stereo jack 10*a* and speakers 14 and 15 (in phantom). In some implementations, the cap may further include a wireless receiver, such as a Bluetooth connection that allows reception of audio signals, e.g, from a nearby digital music device.

FIG. 9 also illustrates the contoured pliable battery holder 13 housing the contoured rigid battery holder 19 with a flap 21 in an open position therefrom. Generally, the flap 21 is capable of moving from an open position to a closed position. In the open position (as shown), the flap 21 reveals the battery holder/forehead cushion 13 housing battery holder 19. The flap 21 may be moved to the open position when a user is changing the batteries in the battery holder 19. In the closed position (not shown), the flap 21 conceals the battery holder/forehead cushion 13 housing battery holder 19. The flap 21 may be moved to the closed position when the baseball-style cap combination 16 is being worn by the user. The flap 21 may include attaching means such as VELCRO or equivalent for securing the flap 21 to the crown 16*a* in the closed position. Advantageously, the flap 21 is made of a soft material, such as EVA foam or equivalent which further serves to cushion the forehead of a user, i.e., in addition to the cushioning effect of the contoured pliable battery holder 13.

FIG. 10 illustrates a circuit for use with the baseball-style cap and stereo combination of FIG. 1 according to an embodiment of the invention. As shown, FIG. 10 illustrates a circuit 12 including the ON/OFF switch 10 and the audio stereo jack 10*a*. In one embodiment, the circuit 12 is configured to fit within the sweatband 18 of the baseball-style cap 16. Such size allows for concealment (and therefore protection from the elements and protection from bodily fluids, e.g., sweat from the user) of the circuit 12 while providing an adjustable means to amplify sound emanating from the speakers 14 and 15.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

What is claimed is:

1. A baseball-style cap having amplified stereo speakers, comprising:

a crown adapted to fit a head of a user;

a horizontally extending brim/bill attached to the crown;

a sweatband secured to an inner surface of the crown by at least one edge;

a contoured pliable battery holder having an opening therethrough, the contoured pliable battery holder positioned within the inner surface of the crown above the area of attachment of the horizontally extending brim/bill;

a contoured rigid battery holder positioned within the opening of the contoured pliable battery holder;

a flap having a first end and a second end, the first end secured to the inner surface of the crown at the area of attachment of the horizontally extending brim/bill, the second end removably secured to the inner surface of the crown at an area above the contoured pliable battery holder by attaching means;

a stand-alone amplifier positioned within the sweatband configured to amplify audio signals originating from an adjacent external signal source; and at least two stand-alone speakers integrated within the brim/bill with their direction of sound propagation pointed downward from the brim/bill, the speakers having a thickness equal to or less than the thickness of the brim/bill so that the speakers are concealed within the thickness of the brim/bill wherein the baseball style cap is adapted to receive a signal from an external music signal generator.

2. The baseball-style cap of claim 1 wherein the contoured pliable battery holder comprises a flat surface and a convex surface, the flat surface facing inward and the convex surface facing outward.

3. The baseball-style cap of claim 2 wherein the flat surface is adapted to substantially rest adjacent to a forehead of a user.

4. The baseball-style cap of claim 1 wherein the contoured pliable battery holder is approximately hemispherical-shaped.

5. The baseball-style cap of claim 4 wherein a flat surface of the contoured pliable battery holder is adapted to substantially rest adjacent to a forehead of a user.

6. The baseball-style cap of claim 1 wherein the contoured rigid battery holder is contoured to the shape of a forehead of the user.

7. The baseball-style cap of claim 1 wherein the speakers are connected by wire means to the amplifier.

8. The baseball-style cap of claim 1 wherein the battery holder is connected to the amplifier by wire means.

9. The baseball-style cap of claim 1 wherein the amplifier has an ON/OFF switch located on the side of the amplifier, the ON/OFF switch protruding through an edge of the sweatband.

10. The baseball-style cap of claim 9 wherein the amplifier contains an LED light protruding through the edge of the sweatband, the LED light adapted to illuminate a blue light when the ON/OFF switch is turned ON.

11. The baseball-style cap of claim 10 wherein the amplifier includes a female stereo audio jack connector, the female stereo audio jack connector configured to connect to a male connector of an external music signal generator.

12. The baseball-style cap of claim 11 wherein the external signal generator includes stereo audio cable means, the stereo audio cable means having a male connector to fit in the female stereo audio jack connector on the amplifier.

13. The baseball-style cap of claim 12 wherein a stereophonic signal is provided to the amplified stereo speakers to provide stereophonic music.

14. The baseball-style cap of claim 13 wherein the external music signal generator is one of a compact disc player, MP3 player, AM/FM radio, a device with a 3.5 mm jack or a device that can provide stereophonic music signal.

15. The baseball-style cap of claim 14 wherein the stand-alone amplifier includes a receiver to wirelessly receive the audio signals from the adjacent external signal source.

16. A baseball style cap having integrated stereo speakers, comprising:

a crown adapted to fit a head of a user;

a horizontally extending brim/bill attached to the crown;

a sweatband secured to an inner surface of the crown by at least one edge;

a contoured pliable battery holder having an opening therethrough, the contoured pliable battery holder positioned within the inner surface of the crown above the area of attachment of the horizontally extending brim/bill;

a contoured rigid battery holder positioned within the opening of the contoured pliable battery holder;

a flap having a first end and a second end, the first end secured to the inner surface of the crown at the area of attachment of the horizontally extending brim/bill, the second end removably secured to the inner surface of the crown at an area above the contoured pliable battery holder by attaching means;

at least two stand-alone speakers integrated within the brim/bill with their direction of sound propagation pointed downward from the brim/bill, the speakers having a thickness equal to or less than the thickness of the brim/bill so that the speakers are concealed within the thickness of the brim/bill wherein the baseball style cap is adapted to receive a signal from an external music signal generator; and means to provide external audio signals to the speakers.

17. The baseball style cap of claim 16, further comprising:

means for amplifying audio signals originating from an adjacent external signal source prior to reaching the speakers.

18. The baseball-style cap of claim 16 wherein the contoured pliable battery holder comprises a flat surface and a convex surface, the flat surface facing inward and the convex surface facing outward.

19. The baseball-style cap of claim 18 wherein the flat surface is adapted to substantially rest adjacent to a forehead of a user.

20. The baseball-style cap of claim 19 wherein the contoured rigid battery holder is contoured to the shape of a forehead of the user.

* * * * *